US005853559A

United States Patent [19]

Tamaki et al.

[11] Patent Number: 5,853,559

[45] Date of Patent: Dec. 29, 1998

[54] APPARATUS FOR ELECTROPLATING A SEMICONDUCTOR SUBSTRATE

[75] Inventors: Masahiro Tamaki; Katsuya Kosaki, both of Tokyo, Japan

[73] Assignee: Mitsubishi Denki Kabushiki Kaisha, Tokyo, Japan

[21] Appl. No.: 891,870

[22] Filed: Jul. 9, 1997

[30] Foreign Application Priority Data

Feb. 17, 1997 [JP] Japan ..... P 09-031854

[51] Int. Cl.[6] ..... C25D 7/12; C25B 9/00; B05B 5/025

[52] U.S. Cl. ..... 205/157; 204/277; 118/620

[58] Field of Search ..... 204/277; 205/157; 118/620

[56] References Cited

U.S. PATENT DOCUMENTS 5,084,149 1/1992 Kaczur et al. ..... 204/101
5,256,274 10/1993 Poris ..... 205/123

FOREIGN PATENT DOCUMENTS 1294888 11/1989 Japan .
6188247 7/1994 Japan .

*Primary Examiner*—Kathryn L. Gorgos
*Assistant Examiner*—Edna Wong
*Attorney, Agent, or Firm*—Leydig, Voit and Mayer

[57] ABSTRACT

An electroplating apparatus includes an electroplating tank having a generally flat base on which a semiconductor substrate may be placed with a surface to be electroplated oriented upwardly. A first seal seals a tank body to the flat base and a second seal seals the tank body to a peripheral portion of the surface of the semiconductor substrate. A substantially sealed volume adjacent the surface of the semiconductor substrate is produced. A gas supply tube for pressurizing the volume and an electrolyte discharge arrangement for discharging electrolyte from the volume when pressurized by a gas introduced through the gas supply tube are also provided. The discharge tube extends through a wall of the tank body to a position immediately above the surface of the semiconductor substrate within the volume.

8 Claims, 6 Drawing Sheets

APPARATUS FOR ELECTROPLATING A SEMICONDUCTOR SUBSTRATE

BACKGROUND OF THE INVENTION

1. Field of the Invention

The present invention relates to an apparatus for, and a method of, electroplating a semiconductor substrate to form an electroplated layer.

2. Description of the Prior Art

For discussion of the prior art electroplating technique to which the present invention pertains, reference will be made to FIG. 10 which illustrates such an electroplating apparatus as disclosed in, for example, the Japanese Laid-open Patent Publication No. 1-294888 published in 1989.

The prior art electroplating apparatus shown in FIG. 10 includes a plating tank 1. A semiconductor substrate, for example, a wafer 6 having its entire surfaces covered by a power supply metal layer is set at the bottom of the plating tank 1 and fixed in position with a power supply contact pin 10 secured thereto. The plating tank 1 includes an electrolyte supply tube 3 supported above the plating tank 1, an electrolyte discharge tube 4, and a mesh-shaped anode 14.

After the wafer 6 has been set within the plating tank 1, an electrolyte 7 is introduced into the plating tank 1 from above through the electrolyte supply tube 3 to fill the latter with the electrolyte. Supply of the electrolyte from above onto the wafer 6 within the plating tank 1 is effective to minimize adhesion of bubbles to the surfaces of the wafer 6 to thereby reduce the possibility of forming an uneven metallic coating.

After the wafer 6 has been electroplated in a standard manner, nitrogen gas is introduced into the plating tank 1 through the electrolyte supply tube 3 to purge the electrolyte 7 within the plating tank 1 through the electrolyte discharge tube 4 to an electrolyte reservoir in anticipation of reuse of the recovered electrolyte. The plating tank 1 having a small quantity of the electrolyte remaining therein is washed with pure water, followed by removal of the wafer 6 from the plating tank 1.

It has been a customary practice to recover the electrolyte by introducing the nitrogen gas through the electrolyte supply tube 3 to purge the electrolyte through the electrolyte discharge tube 4 towards the electrolyte reservoir. It has however been found that with this prior art technique it is not possible to recover the entire amount of the electrolyte used, and a quantity of the electrolyte remaining within the plating tank 1 has long been washed out in admixture with pure water each time the electroplating is executed.

Where the electrolyte 7 is discarded each time the electroplating is carried out, the quantity of the electrolyte that can be reused within the plating tank 1 decreases and must therefore be supplemented. The necessity of the electrolyte being supplemented results in the necessity of monitoring the quantity of the electrolyte regularly so that the amount of fresh electrolyte to be added can be determined. Also, where the electrolyte contains an expensive element such as, for example, Au (gold), addition of the electrolyte results in a increase.

SUMMARY OF THE INVENTION

Accordingly, the present invention is intended to provide an improved electroplating apparatus effective to minimize waste of the electrolyte and to accomplish a high recovery of the electrolyte.

The present invention is based on the finding that the recovery of the electrolyte can be increased if use is made of an electrolyte discharge means including a discharge tube that extends to a position above and in the vicinity of a semiconductor substrate while a peripheral portion of the semiconductor substrate is sealed off by a sealing member to avoid unnecessary deposition of a metal on that peripheral portion.

Specifically, to this end the present invention provides an electroplating apparatus comprising an electroplating tank assembly including a generally flat base on which a semiconductor substrate, for example, a wafer is placed with its upper surface oriented upwardly, a sealing means for sealing a peripheral portion of the upper surface of the semiconductor substrate, and a tank body separate from the flat base and adapted to be capped onto the flat base. The tank body when capped onto the flat base cooperates with the sealing means to define a substantially sealed electrolyte bath above the semiconductor substrate placed on the flat base.

The electroplating apparatus also comprises a gas introducing means for pressurizing the sealed electrolyte bath, and an electrolyte discharge means for discharging an electrolyte from the sealed electrolyte bath then pressurized by a gaseous medium introduced by the gas introducing means. The electrolyte discharge means includes a discharge tube extending through a wall of the tank body to a position immediately above the semiconductor substrate within the sealed electrolyte bath.

According to the present invention, since the peripheral portion of the semiconductor substrate is sealed by the sealing member used to avoid deposition of an electroplated layer on that peripheral portion of the semiconductor substrate and since the discharge tube forming a part of the electrolyte discharge means extends to a position immediately above and in the vicinity of the upper surface of the semiconductor substrate, a quantity of electrolyte remaining above the semiconductor substrate and inside the sealing member which has hitherto been considered difficult to remove can be satisfactorily recovered to thereby increase the recovery of the electrolyte. As a result thereof, the efficiency of reuse of the electrolyte can be increased, accompanied by reduction in cost associated with the electroplating operation.

Also, in the electroplating apparatus designed to recover the electrolyte for reuse, it is possible to reduce any possible burden of controlling the amount of the electrolyte being reduced.

Preferably, the discharge tube is disposed in the vicinity of a peripheral region of an interior of the sealed electrolyte bath. This arrangement makes it possible to accomplish a uniformity in convection of the electrolyte during the electroplating to thereby accomplish formation of the electroplated layer of a uniform thickness.

The electrolyte discharge means may include a means for evacuating the electrolyte from inside the sealed electrolyte bath. In such case, the recovery of the electrolyte remaining above the semiconductor substrate can be increased.

According to another aspect of the present invention, there is provided a method of electroplating a semiconductor substrate which comprises placing the semiconductor substrate on a base with an upper surface thereof oriented upwardly, placing a tank body onto the base so as to seal a peripheral portion of the upper surface of the semiconductor substrate to define a sealed electrolyte bath above the semiconductor substrate for accommodating an electrolyte, depositing an electroplated layer on the upper surface of the semiconductor substrate, sealing the sealed electrolyte bath and introducing a gaseous medium into the sealed electrolyte bath to pressurize the bath to thereby discharge the electrolyte above the semiconductor substrate through an electrolyte discharge means including a discharge tube extending through a wall of the tank body to a position immediately above the semiconductor substrate within the sealed electrolyte bath.

According to a further aspect of the present invention, there is provided a method of electroplating a semiconductor substrate which comprises placing the semiconductor substrate on a base with an upper surface thereof oriented upwardly, placing a tank body onto the base so as to seal a peripheral portion of the upper surface of the semiconductor substrate to define a sealed electrolyte bath above the semiconductor substrate for accommodating an electrolyte, depositing an electroplated layer on the upper surface of the semiconductor substrate, evacuating the electrolyte above the semiconductor substrate through an electrolyte discharge means including a discharge tube extending through a wall of the tank body to a position immediately above the semiconductor substrate within the sealed electrolyte bath.

Evacuating of the electrolyte remaining above the semiconductor substrate to discharge it is effective to further increase the recovery of the electrolyte.

BRIEF DESCRIPTION OF THE DRAWINGS

The present invention will become readily understood from the following description taken in conjunction with preferred embodiments thereof with reference to the accompanying drawings wherein like parts are designated by like reference numeral and wherein.

DETAILED DESCRIPTION OF THE EMBODIMENTS

Figure 1:
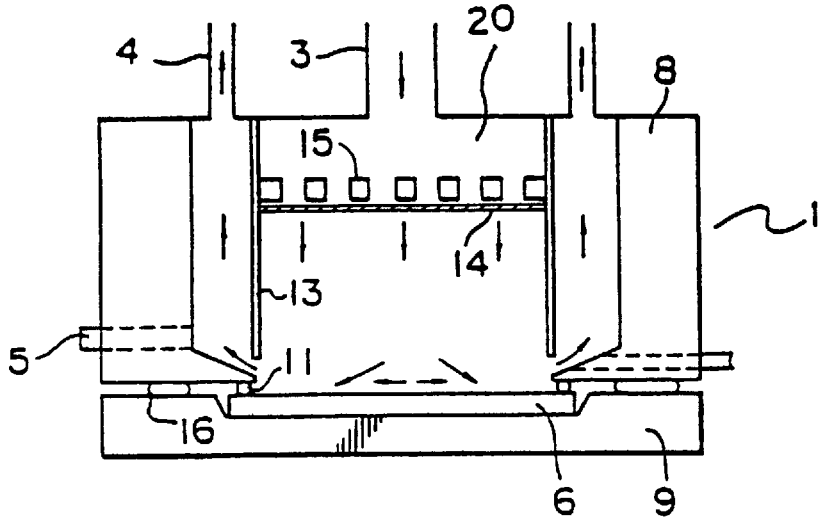
FIG. 1 is a schematic side sectional view of an electroplating apparatus according to a first preferred embodiment of the present invention.
Figure 2:
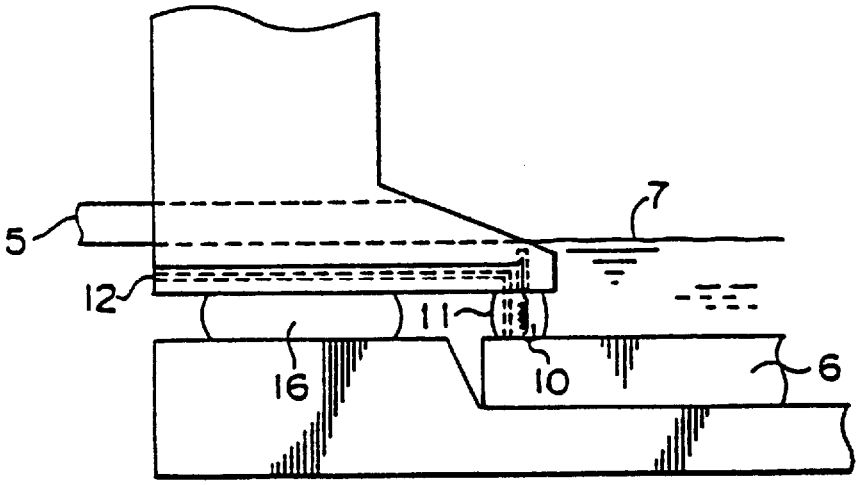
FIG. 2 is a fragmentary side sectional view, on an enlarged scale, of a portion of the electroplating apparatus shown in FIG. 1.
Figure 3:
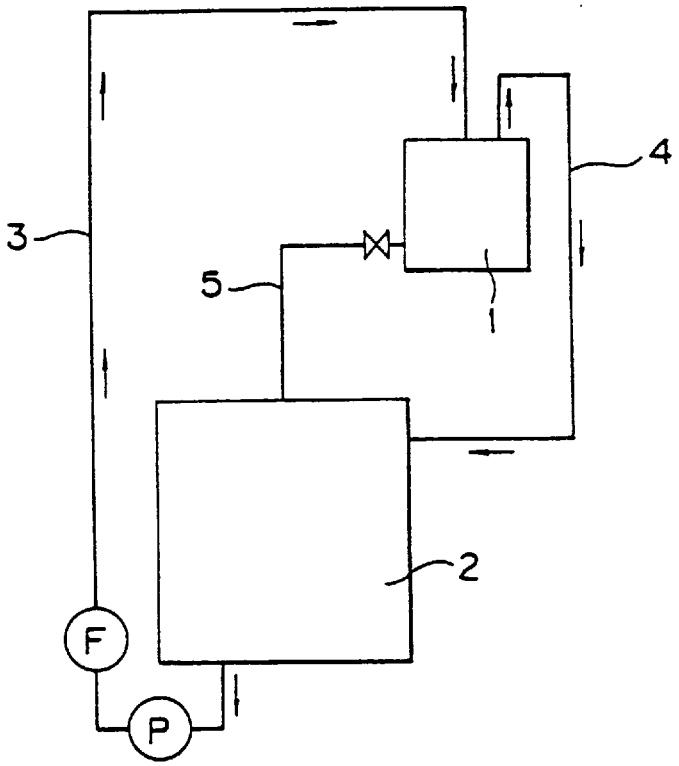
FIG. 3 is a schematic diagram showing a fluid circuit employed in association with the electroplating apparatus shown in FIG. 1.

Referring first to FIGS. 1 to 3, an electroplating apparatus shown therein in accordance with a first preferred embodiment of the present invention comprises an electrolyte tank 1 including a generally cap-like tank body 8 opening downwardly and a generally flat base 9 that closes the opening of the electrolyte tank 1 when the latter is mounted on the flat base 9.

A semiconductor substrate, for example, a wafer 6 having its entire surface coated with a power supply metal layer, is placed on the flat base with one of its major surfaces remote from the flat base oriented upwardly. After placement of the wafer 6 on the flat base, a primary O-ring seal 11 having a contact pin 10 embedded, or otherwise built, therein, is placed on a peripheral portion of the wafer 6 with the contact pin 10 held in electrical connection with the wafer 6. Subsequent placement of the tank body 8 on the flat base 9 results in formation of a substantially sealed electrolyte bath 20 delimited by the tank body 8 and the flat base 9, in cooperation with the O-ring seal 11. It is to be noted that the O-ring seal 11 also has a $N_2$ blow-off release mechanism 12 built therein for assuredly removing the wafer 9 from the flat base 6.

The electrolyte tank 1 includes an electrolyte supply tube 3 supported atop the cap-like tank body 8, an electrolyte discharge passage 4 defined in the tank body 8 extending upwardly from a position adjacent the bottom opening of the cap-like tank body 8 to the top thereof. An electrolyte is supplied from above into the sealed electrolyte bath 20 to fill the electrolyte tank 1 with the electrolyte, and a drain tube 5 defined in the tank body 8 is positioned adjacent the bottom opening of the cap-like tank body 8.

The electrolyte tank 1 also includes an mesh-like anode 14 positioned inside the tank body 8, and a screening unit 15 also positioned inside the tank body 8 and above the mesh-like anode plate 14 for uniformly dispensing the electrolyte, falling downwardly within the sealed electrolyte bath 20, so as to be uniformly distributed over the wafer 6 resting on the flat base 9. Reference numeral 16 represents an auxiliary O-ring seal which is, when the sealed electrolyte chamber 20 is formed with the cap-like tank body 8 is on the flat base 9 as shown in FIG. 1, sandwiched between the cap-like tank body 8 and a peripheral portion of the flat base 9 radially outwardly of the O-ring seal 11 to ensure that no electrolyte within the sealed electrolyte chamber 20 will not leak to the outside of the electrolyte tank 1.

Electroplating of the wafer 6 is carried out in a standard manner known to those skilled in the art. Since the manner of electroplating, the wafer 6 is not the subject of the present invention, it will not be discussed herein for the sake of brevity. In any event, after the electroplating has been completed, nitrogen gas under pressure is introduced into the sealed electrolyte bath 20 through the electrolyte supply tube 3 which is then no longer used for the supply of the electrolyte. Introduction of the nitrogen gas under pressure results in the electrolyte being purged into the electrolyte discharge passage 4 and also into the drain tube 5 so as to flow to an electrolyte reservoir 2 as shown in FIG. 3 so that the electrolyte so discharged can be recovered for reuse during a subsequent electroplating operation. After the electrolyte has been discharged in the manner described above, the electrolyte tank 1 is washed with pure water, and the tank body 8 and the flat base 9 are then separated from each other for removal of the electroplated wafer 6.

In the electroplating apparatus of the structure shown in FIGS. 1 and 2, that peripheral portion of the wafer 6 is sealed by the primary O-ring seal 11 then clamped between it and the bottom of the tank body 8, and only the remaining area of the wafer 6 inside the primary O-ring seal 11 is electroplated. Accordingly, no electroplated layer will be formed on that peripheral portion of the wafer 6 and, accordingly, the possibility of an electroplated layer being formed on an unnecessary portion of the wafer can advantageously be avoided to minimize waste of the electrolyte.

In the electroplating apparatus shown in and discussed with reference to FIGS. 1 and 2, it has been found that the electrolyte 7 cannot be completely discharged and a quantity of the electrolyte 7 below the level of the drain tube 5 and specifically filling a space above the wafer 6 and inside the primary O-ring seal 11 tends to remain unremoved.

Figure 4:
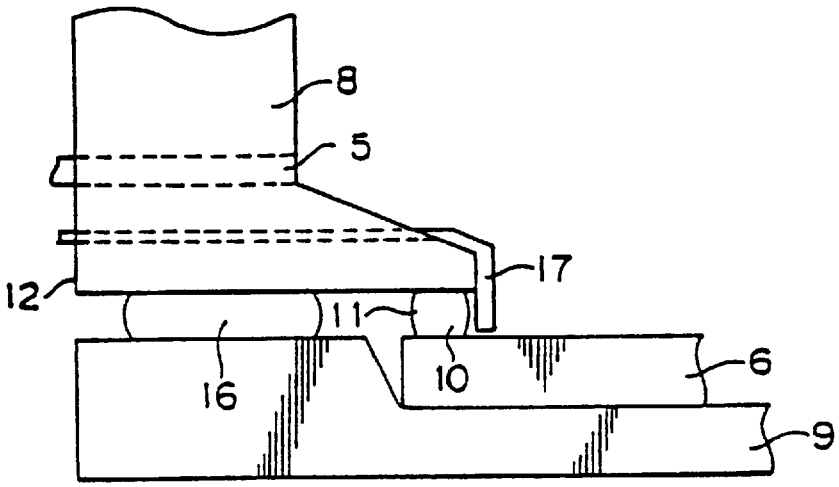
FIG. 4 is a view similar to FIG. 2, showing a modified form of the electroplating apparatus shown in FIG. 1

In order to avoid this problem to increase the recovery of the electrolyte, use may be made of a second drain tube 17 separate from the drain tube 5 as shown in FIG. 4. This second drain tube 17 has a suction end positioned in the vicinity of the upper surface of the wafer 6 and inside the primary O-ring seal 11 so that the quantity of the electrolyte 7 remaining above the wafer 6 and inside the primary O-ring seal 11 can be drained.

Recovery of the electrolyte 7 is carried out in a manner similar to that described in connection with the foregoing embodiment. Specifically, while the tank body 8 is on the flat base 9 to define the sealed electrolyte bath 20, nitrogen gas is introduced into the sealed electrolyte bath 20 through the electrolyte supply tube 3 to pressurize the inside of the electrolyte bath 20 to purge the electrolyte 7 to the reservoir 2 through the discharge passage and the drain tubes.

According to the modification shown in FIG. 4, the quantity of the electrolyte 7 tending to remain above the wafer 6 and inside the primary O-ring seal 11 and which is difficult to remove with the apparatus shown in FIGS. 1 and 2 can be satisfactorily recovered and, therefore, the amount of the electrolyte 7 which may be discarded each time one cycle of the electroplating operation completed can advantageously be minimized. This leads to easy maintenance and control of the electroplating apparatus and also to a reduction in the cost involved in performing the electroplating operation.

It is to be noted that the suction end of the second drain tube 17 is preferably held at a position spaced a slight distance from the upper surface of the wafer 6 and in the vicinity of the primary O-ring seal 11 so that the pattern of circulation of the electrolyte within the sealed electrolyte bath 20 will not be disturbed. Also, the second drain tube 17, except for a suction end portion situated inside the sealed electrolyte bath 20, may be embedded in the wall forming the tank body 8.

Although in the modification shown in FIG. 4, two drain tubes such as those indicated by 5 and 17 have been used, either the drain tube 5 or the drain tube 17 may be dispensed with. Where the second drain tube 17 is dispensed with, the first drain tube 5 should have a suction end positioned in a manner similar to the suction end of the second drain tube 17 described with reference to FIG. 4.

Figure 5:
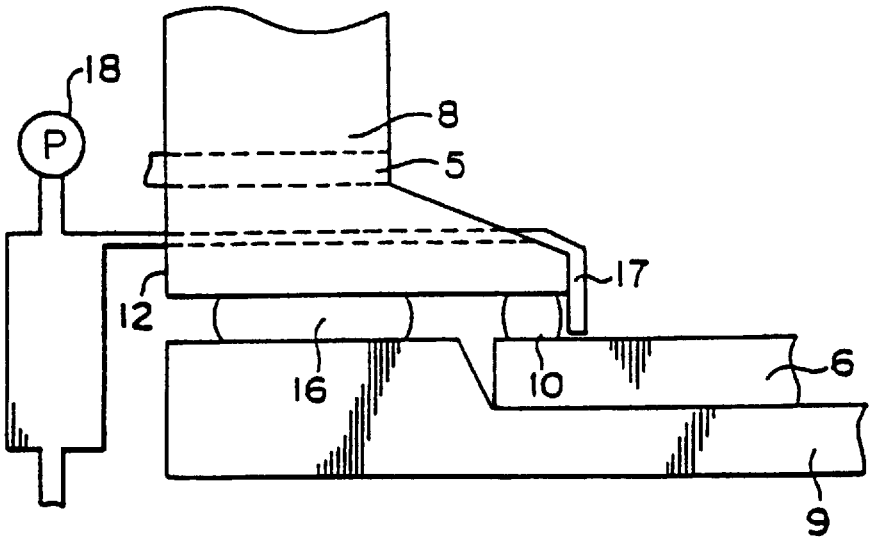
FIG. 5 is a view similar to FIG. 2, showing a second preferred embodiment of the present invention.

An electroplating apparatus according to a second embodiment of the present invention is shown in FIG. 5. This electroplating apparatus is substantially similar to that shown in FIG. 4, but differs therefrom in that in the apparatus shown in FIG. 5 the second drain tube 17 has the opposite end in communication with a pump 18 installed outside the electrolyte tank 1 so that, after the electrolyte 7 within the sealed electrolyte bath 20 has been discharged to the reservoir through the discharge passage 4 in the manner described in connection with the foregoing embodiment, the quantity of the electrolyte remaining inside the primary O-ring seal 11 and above the wafer 6 can be pumped by the pump 18 out of the electrolyte tank 1 to further increase the recovery of the electrolyte and also to further minimize reduction in the quantity of the electrolyte that can be reused.

In a third embodiment of the present invention shown in FIG. 6, the electrolyte tank 1 itself is supported in a tiltable fashion by means of a tilt mechanism (not shown) so that, when the electrolyte tank 1 is tilted with the flat base 9 consequently inclined, the quantity of the electrolyte remaining above the wafer 6 and below the level of the drain tube 5 can be poured out of the electrolyte tank 1 through the drain tube 5.

Figure 6:
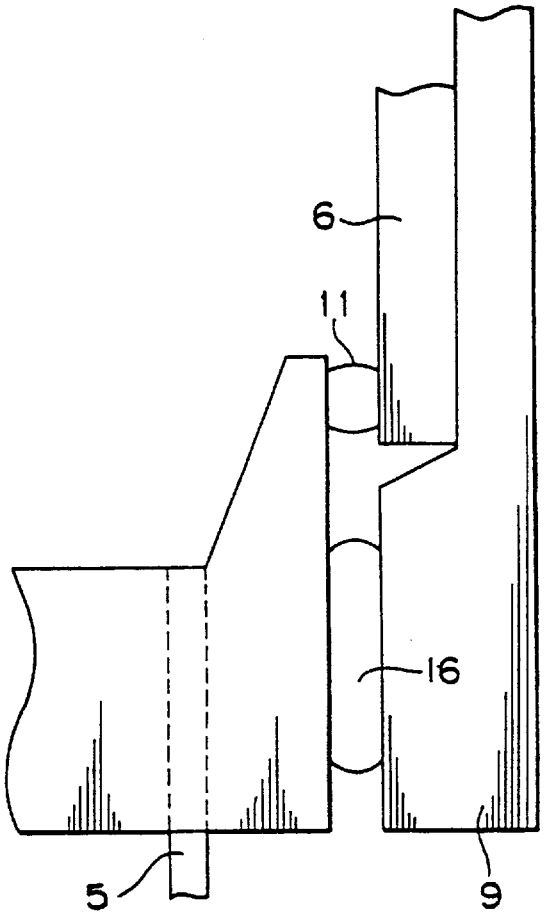
FIG. 6 is a view similar to FIG. 2, showing a third preferred embodiment of the present invention.

The electroplating apparatus according to the embodiment shown in FIG. 6 is advantageous in that, even though the tilt mechanism is required, the use of the second drain tube such as shown by 17 in FIGS. 4 and 5 need not be employed, making it possible to avoid the possibility that an interior structure inside the electrolyte tank 1 may be complicated and also to avoid any obstacle which would otherwise disturb the pattern of circulation of the electrolyte 7 within the sealed electrolyte bath 20.

Figure 7:
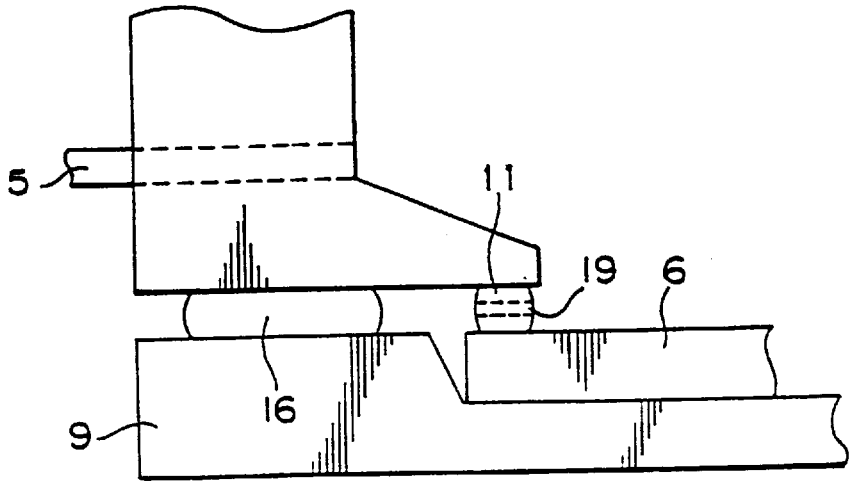
FIG. 7 is a view similar to FIG. 2, showing a fourth preferred embodiment of the present invention.
Figure 8:
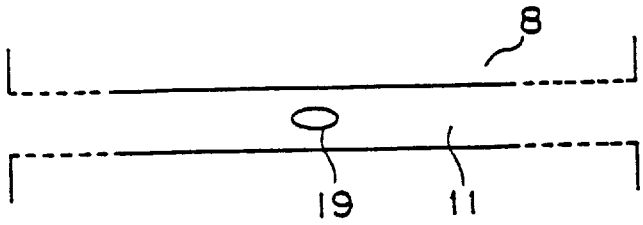
FIG. 8 is a schematic diagram of an O-ring seal, on an enlarged scale, employed in the electroplating apparatus according to the fourth embodiment of the present invention, showing the O-ring seal held in a condition during discharge of the electrolyte.
Figure 9:
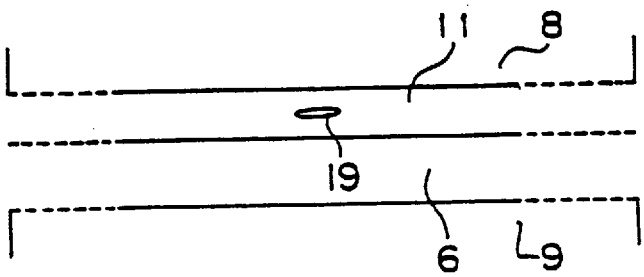
FIG. 9 is a diagram similar to FIG. 8, showing the O-ring seal held in a different condition during electroplating.
Figure 10:
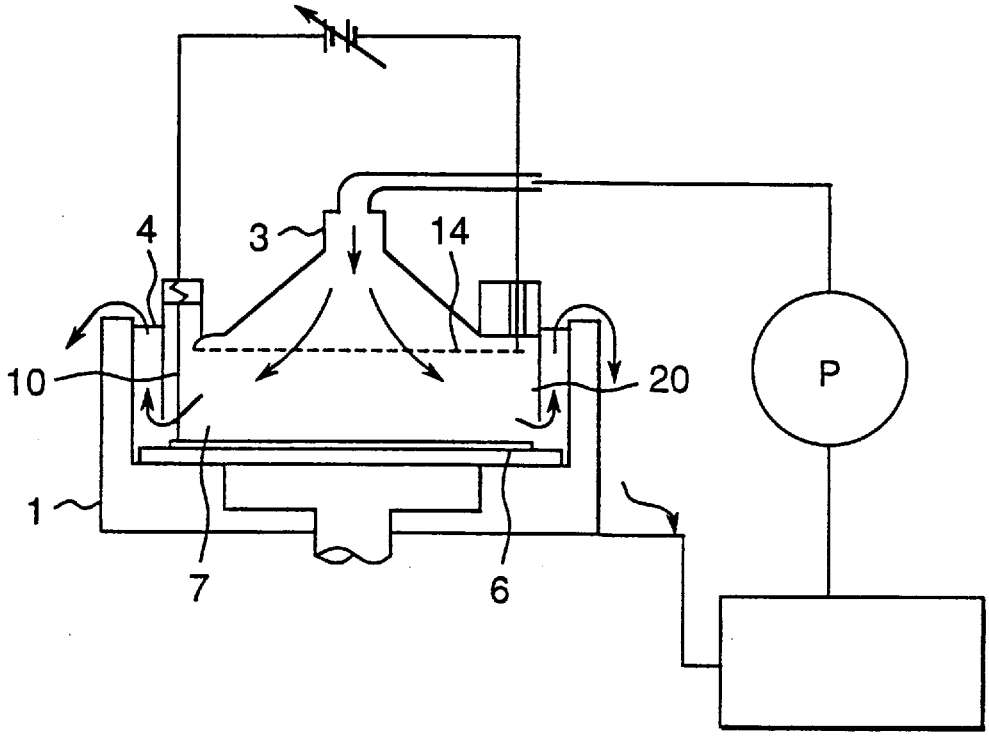
Fig.10 PRIOR ART
FIG. 10 is a schematic side sectional view showing the prior art electroplating apparatus.

In a fourth preferred embodiment of the present invention shown in FIGS. 7 to 9, the primary O-ring seal 11 includes at least one drain perforation 19 extending completely through the thickness thereof. Since the primary O-ring seal 11 is made of an elastic material, the drain perforation 19 defined in the primary O-ring seal 11 is closed as shown in FIG. 9 when and so long as the cap-like tank body 8 and the flat base 9 are tightly clamped together to define the sealed electrolyte bath 20, but is open as shown in FIG. 8, when the pressure used to compress the primary O-ring seal 11 is lessened as one of the tank body 8 and the flat base 9 is moved a slight distance away from the other of the tank body 8 and the flat base 9.

During the electroplating process, the tank body 8 and the flat base 9 are tightly clamped together to define the sealed electrolyte bath 20 and, at this time, the primary O-ring seal 11 is strongly compressed with the drain perforation 19 consequently closed as shown in FIG. 9. However, after completion of the electroplating process, the electrolyte 7 within the sealed electrolyte bath 20 has been purged by the action of nitrogen gas under pressure, and one of the tank body 8 and the flat base 9 is subsequently moved a slight distance away from the other of the tank body 8 and the flat base 9 to lessen the pressure applied to the primary O-ring seal 11, the drain perforation 19 is opened as shown in FIG. 8. Thus, that the quantity of the electrolyte 7 remaining above the wafer 6 and inside the primary O-ring seal 11 can be discharged through the drain perforation 19 to the reservoir. Thus, it will readily be seen that when the drain perforation 19 is opened, that quantity of the electrolyte 7 remaining above and inside the primary O-ring seal 11 can be recovered.

It is to be noted that the quantity of the electrolyte 7 remaining above and inside the primary O-ring seal 11 and recovered therefrom can be discharged outside of the electrolyte tank 1 through a discharge port (not shown) defined at the bottom of the electrolyte tank 1 and is then recovered in the reservoir 2.

As hereinbefore fully described, with the electroplating apparatus embodying the present invention, it is possible to avoid deposition of an electroplated layer on the outer peripheral portion of the wafer to minimize waste of the electrolyte. In addition, the quantity of the electrolyte which remains at the bottom of the electrolyte tank and which has hitherto been difficult to recover can be satisfactorily recovered to increase the recovery of the electrolyte.

This leads to easy maintenance and control of the electroplating apparatus and also to reduction in cost involved in the electroplating operation.

Although the present invention has been described in connection with preferred embodiments with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. An electroplating apparatus comprising:

an electrolyte tank including a base for supporting a semiconductor wafer, a tank body sealable at a first seal to the base to define a volume inside the electrolyte tank, and sealing means for sealing a peripheral portion of an upper surface of a semiconductor wafer supported on the base in the tank to the tank body at a second seal;

gas introducing means for pressurizing the volume; and electrolyte discharge means for discharging an electrolyte from the volume pressurized by a gas introduced by the gas introducing means, the electrolyte discharge means including a discharge tube extending through a wall of the tank body to a position immediately above the semiconductor wafer within the volume.

2. The electroplating apparatus as claimed in claim 1, wherein the discharge tube is disposed in the vicinity of a peripheral region of the volume.

3. The electroplating apparatus as claimed in claim 1, wherein the electrolyte discharge means includes a means for sucking the electrolyte from inside the volume.

4. The electroplating apparatus of claim 1, wherein the sealing means comprises a compressible O-ring including a through-hole that is substantially closed only when the tank body is strongly urged against the base and is, otherwise, open for discharging electrolyte from the volume.

5. The electroplating apparatus of claim 1, wherein the sealing means comprises a compressible O-ring including an electrical conductor for making an electrical contact to the semiconductor wafer.

6. The electroplating apparatus of claim 5, wherein the O-ring includes a through-hole cooperating with a through-hole in the tank body for supplying a gas to remove the wafer from the semiconductor base.

7. A method of electroplating a semiconductor substrate comprising:

placing a semiconductor substrate on a base;

placing a tank body on the base, sealing the tank body to the base at a first seal and sealing a peripheral portion of an upper surface of the semiconductor substrate to the tank body at a second seal to define a volume adjacent the semiconductor substrate;

supplying an electrolyte to the volume and electroplating an electroplated layer on the upper surface of the semiconductor substrate; and sealing the volume and introducing a gas into the volume to discharge the electrolyte through an electrolyte discharge means including a discharge tube extending through a wall of the tank body to a position immediately above the semiconductor substrate within the volume.

8. A method of electroplating a semiconductor substrate comprising:

placing a semiconductor substrate on a base;

placing a tank body on the base, sealing the tank body to the base at a first seal and sealing a peripheral portion of an upper surface of the semiconductor substrate to the tank body at a second seal to define a volume adjacent the semiconductor substrate;

supplying an electrolyte to the volume and electroplating an electroplated layer on the upper surface of the semiconductor substrate; and sucking the electrolyte from above the semiconductor substrate through an electrolyte discharge means including a discharge tube extending through a wall of the tank body to a position immediately above the semiconductor substrate within the volume.

* * * * *